United States Patent [19]

Hershberger

[11] Patent Number: 4,520,498

[45] Date of Patent: May 28, 1985

[54] AM STEREO MODULATOR

[75] Inventor: David L. Hershberger, Quincy, Ill.

[73] Assignee: Harris Corporation, Melbourne, Fla.

[21] Appl. No.: 507,563

[22] Filed: Jun. 24, 1983

[51] Int. Cl.[3] ..... H04H 5/00

[52] U.S. Cl. ..... 381/16; 332/23 A; 332/37 D; 332/40

[58] Field of Search ..... 381/15, 16, 13; 455/126, 69–71; 332/23 A, 37 R, 37 D, 40, 41

[56] References Cited

U.S. PATENT DOCUMENTS

| | | | |
|---|---|---|---|
| 2,248,757 | 7/1941 | Herold | 250/9 |
| 3,377,559 | 4/1968 | Stewart | 325/61 |
| 3,525,052 | 8/1970 | Clark | 330/149 |
| 4,103,234 | 7/1978 | Orban | 328/169 |
| 4,208,548 | 6/1980 | Orban | 179/1 VL |
| 4,225,751 | 9/1980 | Hershberger | 179/1 GS |
| 4,236,042 | 11/1980 | Leitch | 179/1 GS |
| 4,323,731 | 4/1982 | Hershberger | 381/16 |
| 4,373,115 | 2/1983 | Kahn | 381/16 X |

*Primary Examiner*—Gene Z. Rubinson
*Assistant Examiner*—W. J. Brady
*Attorney, Agent, or Firm*—Yount & Tarolli

[57] ABSTRACT

An AM stereo modulator is disclosed which includes a limiter responsive to first and second audio signals for providing first and second equally limited amplitude limited signals. A quadrature amplitude modulator responds to the first and second amplitude limited signals and provides an amplitude modulated carrier signal having in-phase and quadrature-phase components modulated in accordance with the first and second amplitude limited signals, respectively. A distortion detector monitors the envelope of the quadrature amplitude modulated signal for detecting the extent to which the envelope differs from one of the two amplitude limited signals and for controlling the limiter in accordance with the extent of the difference. The distortion detector can also be used to control quadrature channel signal gain instead of the limiter. A program analyzer determines whether to control quadrature channel signal gain or the limiter with the distortion detector.

10 Claims, 3 Drawing Figures

AM STEREO MODULATOR

BACKGROUND AND FIELD OF THE INVENTION

The present invention relates to the field of AM stereo broadcasting, and more particularly to a quadrature AM modulator for use in commercial radio broadcasting.

Commercial AM radio broadcasting in the United States has long been a monophonic medium. Recently, however, there has been substantial interest in introducing signal formats for broadcasting stereophonically in the AM broadcasting band. Numerous different signal formatting schemes have been proposed. Each scheme has tried to provide optimum stereo performance, while still providing a signal which could be received by existing monophonic AM receivers without objectional levels of distortion. In one system, described in U.S. Pat. No. 4,225,751, a quadrature AM signal is transmitted, however the gain of the quadrature channel signal is dynamically varied in accordance with an estimation of the amount of distortion which the signal will cause in a conventional monophonic receiver. A pilot signal is modulated in accordance with the varying gain of the quadrature channel signal and is transmitted as part of the quadrature signal. A stereo receiver demodulates the pilot signal to recover a gain control signal, and uses the gain control signal to adjust the gain of the quadrature channel signal so as to compensate for the varying gain introduced at the transmitter.

SUMMARY OF THE INVENTION

It is an object of the present invention to provide a new AM stereo modulator.

It is another object of the present invention to provide an AM stereo modulator which transmits a QAM signal, but which does not require that gain control information be communicated along with the modulated signal.

It is yet another object of the present invention to provide an AM stereo modulator wherein the gains of the program signals are controlled so as to control distortion in a conventional monophonic AM receiver.

In accordance with the present invention, an AM stereo modulator is provided. The modulator includes limiter means responsive to first and second audio frequency signals for providing first and second amplitude limited signals in response thereto, where the first and second amplitude limited signals are substantially equally limited. A quadrature amplitude modulator means is included which is responsive to the first and second amplitude limited signals for providing an amplitude modulated carrier signal having in-phase and quadrature-phase components modulated in accordance with the first and second amplitude limited signals, respectively. Distortion detector means is included for detecting the extent to which the envelope of the modulated carrier signal differs from the first amplitude limited signal and for controlling the limiter means in accordance with the detected level of distortion.

BRIEF DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
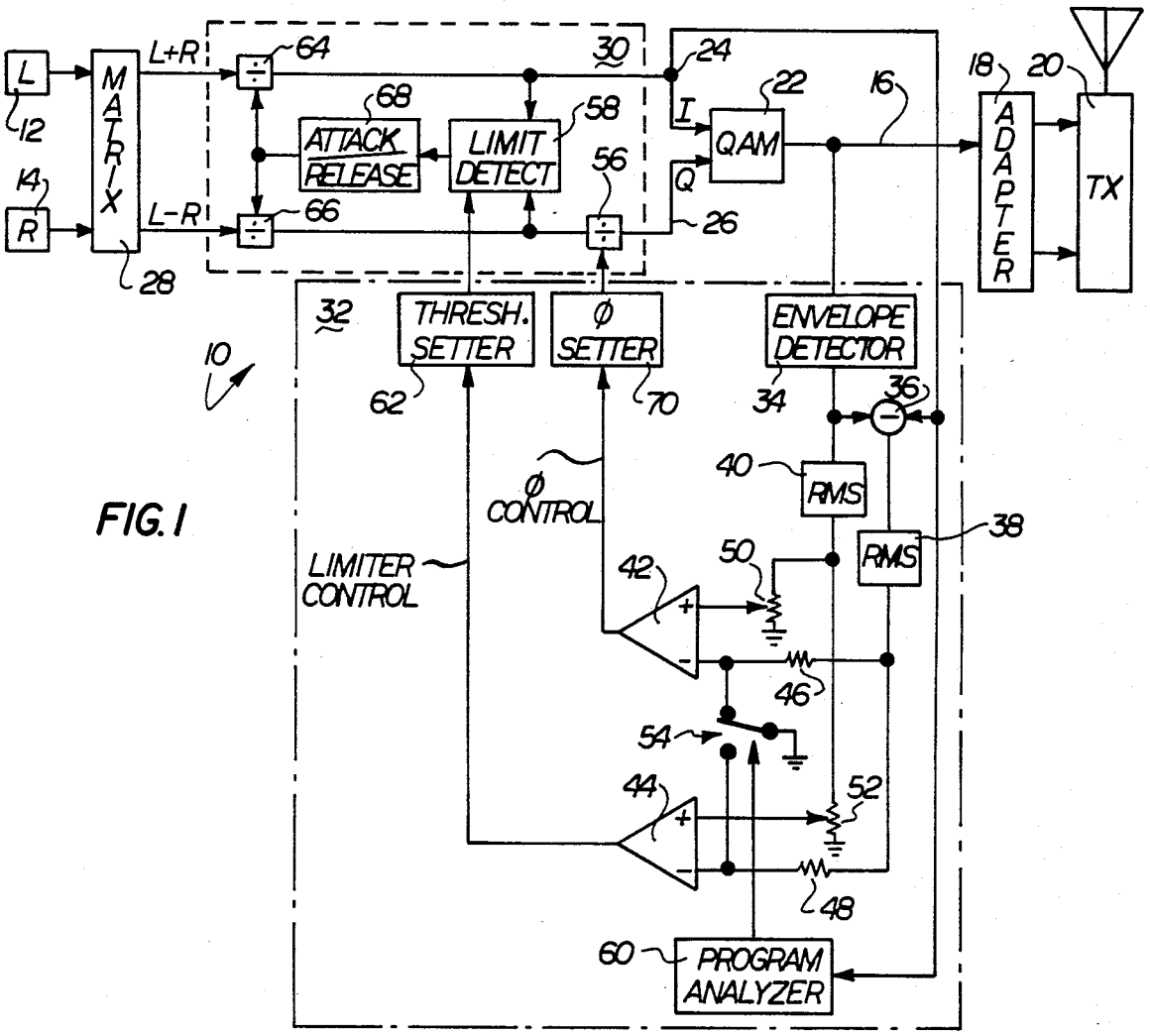
FIG. 1 is a block diagram of an AM stereo modulator in accordance with the teachings of the present invention.

An AM stereo modulator incorporating the teachings of the present invention is shown in block diagram form in FIG. 1. The AM stereo modulator 10 responds to two program signals generated by signal sources 12 and 14. The signals generated by the signal sources 12 and 14 are audio frequency signals and are usually stereophonic representations of a single program. They will be referred to hereinafter as the "left" (L) and "right" (R) signals. The modulator 10 modulates an RF carrier signal as a function of the L and R signals. The resulting low level modulated RF signal appears on an output line 16. A conventional adapter circuit 18 separates the low level RF signal into audio and RF components and then applies the audio and RF components separately to a conventional AM transmitter 20.

The heart of the modulator 10 is a conventional quadrature amplitude modulator 22 having input lines 24 and 26 upon which two modulating signals are applied. The output of the quadrature amplitude modulator 22 is the output line 16 of the modulator 10. The quadrature amplitude modulator 22 modulates a low level RF carrier signal such that the in-phase component of the modulated RF signal is amplitude modulated with the signal on the input line 24 (occasionally referred to hereinafter as the "I" input), whereas the quadrature phase component of the modulated RF carrier signal is double-sideband suppressed-carrier modulated with the signal appearing on the other input line 26 (sometimes referred to hereinafter as the "Q" input).

The I and Q input signals are derived from the L and R signals by an audio matrix circuit 28. The matrix circuit 28 adds the L and R signals to generate a sum signal (L+R), and subtracts the L and R signals to generate a difference signal (L−R). The (L+R) and (L−R) signals are applied to the I and Q inputs, respectively, of the quadrature amplitude modulator 22 through gain adjustment circuitry, generally indicated in FIG. 1 at 30. The gain adjustment circuitry is controlled by a distortion estimator and corrector circuit 32. The distortion estimation and gain adjustment circuitry is included to control distortion in monophonic receivers. For simplicity of description, certain elements of the modulator of FIG. 1 have been omitted. For example, the modulator will also preferably include circuitry for generating a stereo pilot signal and for combining the pilot signal with the quadrature channel signal.

The signal transmitted by the transmitter 20 has an envelope which is equal to the vector sum of the in-phase and quadrature-phase components of the QAM signal generated by the modulator 22. When the L and R signals contain no stereo information, the (L−R) signal will be zero, and hence the QAM signal will include essentially no quadrature component. The envelope of the transmitted signal will then correspond to the (L+R) signal, alone. At other times, however, some quadrature channel signal component will be present, hence the envelope of the signal will differ from the (L+R) signal to some extent.

Conventional monophonic receivers include envelope detectors for detecting the envelopes of the received signals, and utilize the envelope signal as the receiver output signal. To minimize distortion in a monophonic receiver, the envelope should be close to "monophonic" (i.e., to L+R) regardless of whether the signal does or does not include stereo information. When the signal is completely monophonic, the envelope of the RF signal will correspond to the (L+R) signal provided by the audio matrix circuit 28. Thus, the monophonic receiver will provide a signal which is accurately representative of the sum of the L and R audio signals. When some (L−R) component is present, however, the envelope signal recovered by a conventional monophonic receiver differs from the (L+R) signal by an amount which varies with the amplitude of the (L−R) component. The difference is distortion. In many cases, the distortion is unnoticeable to a listener, and is thus unobjectionable. For some program content, however, the quadrature component will become so large that noticeable and possibly objectionable levels of distortion are present in a conventional monophonic receiver.

The modulator 10 of FIG. 1 functions to automatically control the signals to be broadcast in such a fashion that the distortion experienced in a conventional monophonic receiver does not reach objectionable levels. The distortion estimator circuit 32 and gain control circuit 30 includes elements for controlling distortion in two different ways.

The first method of distortion control incorporated in the circuit of FIG. 1 is similar to the "variable angle" method employed in U.S. Pat. No. 4,225,751. The principal attribute of this method is the adjustment of the gain of the quadrature channel signal in accordance with some dynamic estimate as to the amount of the distortion which will be present in the conventional monophonic receiver when receiving and demodulating the existing quadrature signal. This method will be referred to hereinafter as "phase angle setting" since, as described in the '751 patent, adjustment of the quadrature channel signal gain can be considered to effectively adjust the phase angle between two vector components of the QAM signal, each modulated with a corresponding one of the L and R signals. The distortion estimate is made by the distortion estimator and control circuit 32.

The second method of distortion control involves adjustment of the input signal limiter circuitry in accordance with a similar dynamic estimate as to the amount of distortion in a monophonic receiver. More specifically, the maximum permissible negative excursions of the L and R signals are reduced when distortion approaches objectionable levels. It has been found that this reduces distortion levels. The distortion estimate is again made by the distortion estimator and control circuit 32.

The distortion estimator and control circuit 32 dynamically calculates the amount of the distortion which will be present in a conventional monophonic receiver, and then utilizes one of the two different methods generally described above for reducing distortion in the event that it approaches objectionable levels. The distortion estimator and control circuit 32 includes an envelope detector 34 to simulate a conventional monophonic receiver. The envelope detector 34 has its input coupled to the output of the quadrature amplitude modulator 22. The output of the envelope detector 34 is an audio frequency signal which varies in proportion to variations in the amplitude of the envelope of the RF signal provided by the modulator 22.

The output of the envelope detector 34 is applied to one input of a subtractor circuit 36, the other input of which is connected to the I input line 24 of the modulator 22. The output of the subtractor circuit 36 is thus an audio frequency signal representing the difference between the I channel signal (i.e., the "monophonic" signal) and the resulting envelope of the RF signal provided by modulator 22. The difference signal will be zero when a purely monophonic signal is transmitted, and will have a nonzero amplitude of varying magnitude when some stereo information is present. The output of the subtractor circuit 36 is applied to the input of a root-mean-square (RMS) circuit 38 which provides an output signal corresponding to the RMS amplitude of the signal at the output of the subtractor. Meanwhile, the output of the envelope detector 34 is applied to the input of a second RMS circuit 40. The output of the RMS circuit 40 has a level corresponding to the RMS amplitude of the signal provided at the output of the envelope detector 34.

The distortion estimator and control circuit 32 includes two comparators 42 and 44 for each comparing the RMS envelope with the RMS distortion. Each of the comparators 42 and 44 has the RMS distortion signal (provided by RMS circuit 38) applied to its inverting input through a corresponding resistor 46 and 48. The noninverting inputs of the comparators 42 and 44 are each connected to the wiper arm of a corresponding potentiometer 50 and 52. The two potentiometers 50 and 52 are connected in parallel across the output of the RMS circuit 40. The signals applied to the noninverting inputs of the comparators 42 and 44 are thus attenuated versions of the RMS envelope signal.

The inverting input of each of the comparators is also connected to a corresponding contact of a single-pole/-double-throw switch 54. The toggle arm of the switch 54 is connected to ground. Thus, depending upon the position of the toggle arm of switch 54, either the inverting input of comparator 42 or the inverting input of comparator 44 is connected to ground. The output of the comparator having the grounded inverting input is always at a high voltage level. Thus, that comparator is effectively disabled.

Each of the comparators 42 and 44, when enabled, provides a bilevel output signal indicative of whether the RMS distortion is greater than a specified percentage of the RMS envelope ;of the output signal. As long as the RMS distortion is less than the attenuated RMS envelope signal, the output of the corresponding comparator will be at a high level. If the RMS distortion exceeds the attenuated RMS envelope, however, the output of the corresponding comparator will drop to a low level. The point at which switching between the two output levels occurs can be adjusted by adjusting the potentiometers 50 and 52.

Each of the comparators 42 and 44 controls one of the two different mechanisms for reducing distortion. The comparator 42 controls a Q channel analog divider 56 through a phase angle setter circuit 70, whereas the comparator 44 controls a signal limit detector circuit 58 through a threshold setter circuit 62. Only one of the two comparators 42 or 44 will be enabled at any given time, dependent upon a control signal provided by a program analyzer 60. Usually, the program analyzer causes switch 54 to be in the position shown, wherein comparator 44 is enabled.

The output of comparator 44 is applied to limit detector circuit 58 through a threshold setting circuit 62. The threshold setting circuit 62 converts the bilevel signal appearing at the output of comparator 44 into a variable level signal. If the output of comparator 44 is low, then the DC level of the output of threshold setter circuit 62 will decrease. If the output of the comparator 44 is at a high level, however, the DC level of the output of the threshold setter circuit 62 will increase. Thus, the level of the signal provided by the threshold setter 62 is controlled by the output of comparator 44. The signal at the output of the threshold setter circuit 62 is applied to the input of a limit detector circuit 58, where it is compared against the instantaneous amplitudes of the program signals.

The output of limit detector circuit 58 is a bilevel signal, and is applied to the gain control input of two analog divider circuits 64 and 66 through an attack-/release circuit 68. Analog divider circuit 64 is connected between the (L+R) output of matrix circuit 28 and the I input line 24 of modulator 22. Analog divider 66, on the other hand, is connected between the (L−R) output of matrix 28 and the input of Q channel analog divider circuit 56. Since both analog divider circuits 64 and 66 are controlled by a common gain control signal, the gains of the in-phase and quadrature phase components of the modulated signal are equally affected. Consequently, the signal transmitted by the modulator 22 remains a full quadrature signal, regardless of the gain setting of the analog divider circuits 64 and 66.

The normal function of the limit detector circuit 58, attack/release circuit 68, and analog divider circuits 64 and 66 is to prevent overmodulation of the carrier due to excessive program signal amplitudes. The limit detector circuit 58 includes eight comparators. Each comparators compares the instantaneous amplitude of a corresponding program-related signal (L, inverted L, R, inverted R, L+R, inverted L+R, L−R, or inverted L−R) with a corresponding threshold level. If any one of the eight program-related signals exceeds its threshold, the output of the limit detector circuit 58 shifts to a high logic level, causing the attack/release circuit 68 to rapidly decrease the gain of the (L+R) and (L−R) signals. If none of the thresholds is exceeded, however, the output of the limit detector is low, permitting the circuit 68 to release, slowly increasing the gain of the (L+R) and (L−R) signals. This operation of the limiter components is described in greater detail in U.S. Pat. No. 4,225,751.

The output of the threshold setter circuit 62 represents the threshold signal for two of the eight comparators in the limit detector circuit 58. More specifically, the threshold setter circuit 62 controls the limits in the comparators which monitor the inverted L and inverted R signals. If the threshold signal provided by threshold setter 62 increases, then the permitted amount of negative modulation by the L and R signals will similarly increase. If the output of the threshold setter circuit 62 decreases, however, then the permitted amount of negative modulation by the L and R signals will similarly decline. As mentioned previously, it has been found that distortion in the envelope of the signal provided by the modulator 22 can be reduced by reducing the permitted negative peak amplitudes of the L and R input signals.

Under certain program conditions, program analyzer 60 releases the inverting input of comparator 42 from ground by causing the switch 54 to revert to its second state. The output of comparator 42 then is enabled to switch between high and low voltage levels in accordance with the relative amplitudes of the RMS distortion and RMS envelope, whereas comparator 44 is disabled. The output of comparator 42 is applied to the gain control input of analog divider 56 through a phase setter circuit 70 which is similar to the threshold setter circuit 62. Thus, phase setter 70 provides a variable level output signal whose output level changes in accordance with the proportion of time that the output of comparator 42 is at high and low voltage levels. The output of the phase setter 70 controls the gain of the quadrature channel. If objectionable levels of distortion are present, the gain in the Q channel is reduced. The manner in which the adjustment of the quadrature channel gain reduces distortion in the envelope of the quadrature amplitude modulated signal is described in detail in the aforementioned U.S. Pat. No. 4,225,751, and will not be repeated herein.

Figure 2:
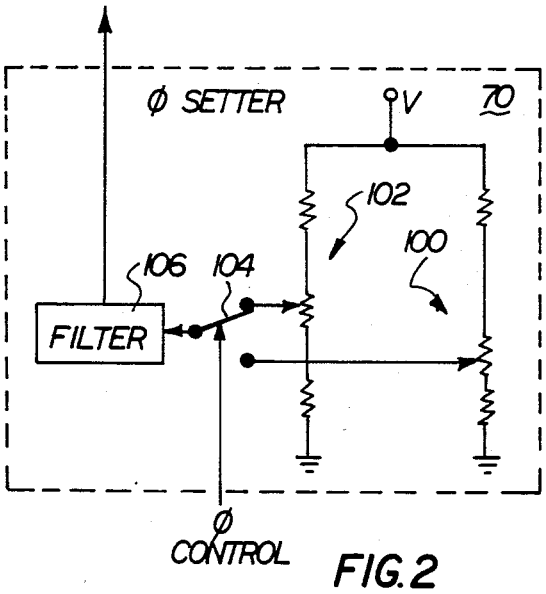
FIG. 2 is a more detailed block diagram of the "phase setter" block of the modulator of FIG. 1; and, FIG. 3 is a more detailed block diagram of the program analyzer of the modulator of FIG. 1.

FIG. 2 presents a more detailed illustration of the contents of the phase setter block 70 in FIG. 1. As shown in FIG. 2, the phase setter 70 includes two DC reference signal sources 100 and 102, each providing a DC reference signal which is manually adjustable. In FIG. 2, the reference signal sources 100 and 102 each comprise three resistances connected in series between a voltage source and ground. The middle resistor of each series combination of three resistors is a potentiometer across whose wiper arm appears the reference voltage. The reference voltage can thus be adjusted by adjusting the setting of the potentiometer. The two reference voltages provided by the reference signal sources 100 and 102 are connected to corresponding contacts of a single-pole/double-throw switch 104. Although represented in FIG. 2 as a mechanical switch, in an actual embodiment, the switch 104 will preferably comprise conventional solid state electronic switch components.

The state of the switch 104 is controlled by the bilevel signal provided by the phase control comparator 42. Dependent upon the state of the phase control signal provided by the phase control comparator 42, the throw arm of switch 104 will be connected either to the reference signal provided by reference signal source 100, or the reference signal provided by reference signal source 102. The throw arm of the switch 104 is connected to a low pass filter 106 whose output is applied to the gain control input of the analog divider 56 of FIG. 1. When the switch 104 is connected to one of the two reference voltages for a long period of time, the output of the filter 106 will correspond to that reference voltage. When the switch 104 is being toggled back and forth between its two states, however, the output of the filter 106 will instead have a value somewhere between the two reference signals provided by the reference signal sources 100 and 102. Its actual value will depends upon the proportion of time that switch 104 spends in each of the two positions. Thus, the output of the filter 106 is a variable level signal whose level is dependent upon the control signal provided by the comparator 42.

The reference voltage sources 100 and 102 will preferably be adjusted to provide maximum and minimum Q channel gain limits coresponding to phase angles of 90° and 30°, respectively. (The phase angle referred to here is the phase angle between the two components of the QAM signal which are each modulated by a corresponding one of the L and R signals. The two vector components are phase displaced from the carrier by equal and opposite amounts. A more detailed description of the various vector components of the QAM may be found in U.S. Pat. No. 4,225,751.) The corresponding reference voltage sources of threshold setter circuit 62 will perferably be adjusted to provide maximum and minimum L and R negative modulation limits of 80% and 50%, respectively.

Figure 3:
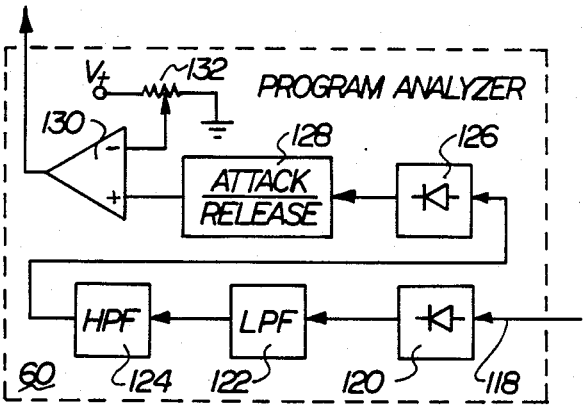

FIG. 3 is a more detailed block diagram of the program analyzer block 60 of FIG. 1. The program analyzer 60 has an input 118 which is connected to the I input line 24 of the modulator 22. The input signal is applied to a peak rectifier 120 which peak rectifies the input signal to provide a signal having only the positive half-cycles of the I signal. The output of the peak rectifier is applied to a low pass filter 122 having a cutoff frequency of approximately 10 Hz. The output signal provided by the low pass filter corresponds to the envelope of the audio frequency signal appearing at the input line 118. A high pass filter 124 having a cutoff frequency of approximately 3 Hz filters the envelope signal. The output of high pass filter 124 represents the AC component of the envelope. Another rectifier 126 rectifies the signal at the output of the high pass filter 124, thereby providing a DC signal at its output representative of the magnitude of the AC component of the envelope of the I channel signal. An attack/release circuit 128 is coupled to the output of the rectifier circuit 126, and provides an output signal which quickly follows rises in the signal provided by the recitfier 126, but releases from the peak value at a slower rate. The output of the attack/release circuit 128 is applied to the noninverting input of the comparator 130, which compares the amplitude of the signal provided by the attack/release circuit 128 with a reference amplitude provided by a potentiometer 132.

Normally, the amplitude of the signal at the output of the attack/release circuit 128 will be greater than the threshold level established by the potentiometer 132. Thus, the output of comparator 130 will be at a high voltage level, wherein the switch 54 (FIG. 1) is in the position shown. Distortion is then controlled by controlling L and R negative modulation limits. The signal then being transmitted can be received by a conventional quadrature receiver, without the provision of any special gain compensation circuitry. If the output of the attack/release circuit 128 drops below the threshold established by potentiometer 132, however, then the output of comparator 130 will abruptly shift to a low voltage level, thereby causing the switch 54 to change states. When the toggle arm of switch 54 changes from the state shown in FIG. 1 to its opposite state, comparator 44 is disabled and comparator 42 is instead enabled. In this case, distortion reduction is accomplished by modifying the gain of the quadrature or Q channel signal, rather than by adjusting the negative modulation L and R limits.

In the AM stereo modulator described above, distortion in the envelope of the AM stereo signal is controlled by equally controlling (L+R) and (L−R) negative modulation limits. Other methods may instead be used to control envelope distortion, however. For example, the output of the threshold setter 62 (FIG. 1) can be used to directly control (L+R) and (L−R) gain. Again, as long as the gains of the two signals are equally controlled, the transmitted signal remains a full quadrature signal. Other modulation limitation approaches could also be used, of course.

Although the invention has been described with respect to a preferred embodiment, it will be appreciated that various rearrangements and alterations of parts may be made without departing from the spirit and scope of the present invention, as defined in the appended claims.

What is claimed is:

1. An AM stereo modulator, comprising:

limiter means responsive to first and second audio frequency signals for providing first and second amplitude limited signals in response thereto, said first and second amplitude limited signals being substantially equally limited, quadrature amplitude modulator means responsive to said first and second amplitude limited signals for providing an amplitude modulated carrier signal having in-phase and quadrature-phase components modulated in accordance with said first and second amplitude limited signals, respectively, and detector means for detecting the extent to which the envelope of said modulated carrier signal differs from said first amplitude limited signal and for controlling the amplitude limitations imposed on said first and second signals by said limiter means in accordance therewith.

2. An AM stereo modulator as set forth in claim 1, and further comprising matrix means responsive to left and right stereo program signals for generting said first and second audio frequency signals such that said first signal is the sum of said left and right stereo program signals and said second signal is the difference between said left and right stereo program signals.

3. An AM stereo modulator as set forth in claim 2 wherein said limiter means includes means for limiting said first and second audio frequency signals when said lef and right signals exceed selected amplitude constraints.

4. An AM stereo modulator as set forth in claim 2, wherein said detector means provides a threshold signal having a level dependent upon said difference and wherein said limiter means includes means for comparing each of said left and right signals against said threshold and for decreasing the gain of both said first and second signals whenever negative peaks of said left signal or said right signal have a greater absolute magnitude than said threshold.

5. An Am stereo modulator as set forth in claim 2 wherein said limiter means includes limit detector means for comparing each of said left and right signals against a threshold and for providing a bilevel output signal having a level dependent upon whether negative peaks of said left or right signals have a greater absolute magnitude than said threshold, attack/release means for receiving said bilevel output signal and for providing a gain control signal with a fast attack when said bilevel signal indicates that said threshold has been exceeded and a slow release otherwise, and first and second gain control means for each controlling the gain of a corresponding one of said first and second signals in accordance with said gain control signal.

6. An AM stereo modulator as set forth in claim 1, and further comprising:

gain control means interposed between said limiter means and said quadrature amplitude modulator means and responsive to said second amplitude limited audio frequency signal for providing a gain adjusted second signal to said quadrature amplitude modulator for modulating said quadrature-phase component, and switch means for selectably causing said detector means to control said gain control means instead of said limiter means.

7. An AM stereo modulator as set forth in claim 6, and further comprising program analyzer means for analyzing at least one of said first and second signals and controlling said switch means in accordance therewith.

8. An AM stereo modulator as set forth in claim 7, wherein said program analyzer means comprises means for detecting the amplitude of the AC component of the envelope of said first signal and for controlling said switch means in accordance therewith.

9. An AM stereo modulator comprising quadrature amplitude modulator means responsive to first and second audio frequency signals for providing an amplitude modulated carrier signal having in-phase and quadrature-phase components modulated in accordance with said first and second audio frequency signals, detector means for detecting the extent to which the envelope of said modulated carrier signal differs from said first audio frequency signal and for providing a modulation control signal in accordance therewith, and, modulation control means for controlling the carrier modulation level in accordance with said control signal, said modulation control means equally affecting carrier modulation by said first and second audio frequency signals.

10. An AM stereo modulator as set forth in claim 9, wherein said modulation control means comprises limiter means responsive to said first and second audio frequency signals for restricting said signals to within equal limits adjusted in accordance with said control signal, and wherein said limited first and second audio signals are provided to said quadrature amplitude modulator means for modulating said carrier.

* * * * *